US011067304B2

(12) United States Patent
Tomita et al.

(10) Patent No.: US 11,067,304 B2
(45) Date of Patent: Jul. 20, 2021

(54) AIR-CONDITIONING APPARATUS

(71) Applicant: Mitsubishi Electric Corporation, Tokyo (JP)

(72) Inventors: Masafumi Tomita, Tokyo (JP); Kazuki Okada, Tokyo (JP); Mizuo Sakai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 76 days.

(21) Appl. No.: 16/349,732

(22) PCT Filed: Jan. 20, 2017

(86) PCT No.: PCT/JP2017/001932
§ 371 (c)(1),
(2) Date: May 14, 2019

(87) PCT Pub. No.: WO2018/134969
PCT Pub. Date: Jul. 26, 2018

(65) Prior Publication Data

US 2019/0383511 A1 Dec. 19, 2019

(51) Int. Cl.
*F24F 11/38* (2018.01)
*F24F 11/36* (2018.01)
(Continued)

(52) U.S. Cl.
CPC ..... *F24F 11/38* (2018.01); *F24F 1/0003* (2013.01); *F24F 11/36* (2018.01); *F24F 11/52* (2018.01);
(Continued)

(58) Field of Classification Search
CPC ..... F24F 11/36; F24F 11/38; F24F 11/52
See application file for complete search history.

(56) References Cited

U.S. PATENT DOCUMENTS 4,545,210 A * 10/1985 Lord ..... F25B 49/02 62/77
4,785,639 A * 11/1988 Biagini ..... F25B 49/02 62/132
(Continued)

FOREIGN PATENT DOCUMENTS

EP 2 733 431 A2 5/2014
JP H04-155144 A 5/1992
(Continued)

OTHER PUBLICATIONS

Office Action dated Jul. 3, 2020 issued in corresponding CN patent application No. 201780083331.8 (and English translation).
(Continued)

*Primary Examiner* — Henry T Crenshaw
(74) *Attorney, Agent, or Firm* — Posz Law Group, PLC

(57) ABSTRACT

An air-conditioning apparatus enables a user to recognize both a leakage of refrigerant and an abnormal condition when a refrigerant leakage condition and the abnormal condition have occurred. When a condition in which a leakage of refrigerant is detected and a condition in which an abnormality is detected have occurred together, the refrigerant leakage condition and the abnormal condition are displayed together on a display part. Consequently, when the condition in which the leakage of refrigerant is detected and the condition in which the abnormality is detected have occurred, the user is allowed to recognize the leakage of refrigerant and the abnormal condition at once.

8 Claims, 8 Drawing Sheets

(51) Int. Cl.

| | |
|---|---|
| ***F24F 11/52*** | (2018.01) |
| ***F24F 1/0003*** | (2019.01) |
| ***F24F 140/12*** | (2018.01) |
| ***F24F 110/12*** | (2018.01) |

(52) U.S. Cl.
CPC ..... *F24F 2110/12* (2018.01); *F24F 2140/12* (2018.01)

(56) References Cited

U.S. PATENT DOCUMENTS

| | | | | |
|---|---|---|---|---|
| 5,694,779 | A * | 12/1997 | Matsushima | F28F 13/06 62/114 |
| 2003/0121278 | A1* | 7/2003 | Ichimura | F25B 43/003 62/474 |
| 2005/0086952 | A1* | 4/2005 | Nonaka | F25D 11/022 62/129 |
| 2005/0126191 | A1* | 6/2005 | Lifson | F25B 49/005 62/129 |
| 2005/0159923 | A1* | 7/2005 | Huang | G06F 11/079 702/183 |
| 2007/0012052 | A1* | 1/2007 | Butler | G05D 23/1904 62/181 |
| 2007/0156373 | A1* | 7/2007 | Yamashita | F25B 49/005 702/182 |
| 2010/0163635 | A1* | 7/2010 | Ye | F24F 11/36 236/94 |
| 2012/0101778 | A1* | 4/2012 | Gyota | G05G 5/06 702/183 |
| 2012/0318011 | A1* | 12/2012 | Ochiai | F25B 49/005 62/127 |
| 2014/0012543 | A1* | 1/2014 | Son | F24F 11/30 702/185 |
| 2014/0163538 | A1* | 6/2014 | Ryba | A61F 7/0085 606/21 |
| 2015/0159931 | A1* | 6/2015 | Okada | F24F 11/30 62/126 |
| 2016/0069584 | A1* | 3/2016 | Holaso | F24F 11/30 700/276 |
| 2016/0178229 | A1* | 6/2016 | Chen | F24F 11/70 62/56 |
| 2017/0198946 | A1* | 7/2017 | Takenaka | F24F 11/89 |
| 2017/0268811 | A1 | 9/2017 | Ochiai et al. | |
| 2018/0045424 | A1* | 2/2018 | Yajima | F24F 11/30 |

FOREIGN PATENT DOCUMENTS

| | | | |
|---|---|---|---|
| JP | H07-334234 | A | 12/1995 |
| JP | H08-263769 | A | 10/1996 |
| JP | H10-019351 | A | 1/1998 |
| JP | 2004-317003 | A | 11/2004 |
| JP | 2008-170047 | A | 7/2008 |
| JP | 2015-197279 | A | 11/2015 |
| WO | 2010/143340 | A1 | 12/2010 |
| WO | 2016/071947 | A1 | 5/2016 |

OTHER PUBLICATIONS

Office Action dated Mar. 31, 2020 issued in corresponding JP patent application No. 2018-562825 (and English translation).
Extended European Search Report dated Oct. 14, 2019 in the corresponding EP application No. 17814285.7.
International Search Report of the International Searching Authority dated Mar. 28, 2017 for the corresponding international application No. PCT/JP2017/001932 (and English translation).
Office Action dated Jan. 19, 2021 issued in corresponding CN patent application No. 201780083331.8 (and English translation).

* cited by examiner

AIR-CONDITIONING APPARATUS

CROSS REFERENCE TO RELATED APPLICATION

This application is a U.S. national stage application of PCT/JP2017/001932 filed on Jan. 20, 2017, the contents of which are incorporated herein by reference.

TECHNICAL FIELD

The present invention relates to an air-conditioning apparatus, and more particularly, to display of abnormal conditions of the air-conditioning apparatus.

BACKGROUND ART

Among air-conditioning apparatus employing a refrigeration cycle, in which heat is absorbed by evaporation of refrigerant, and heat is radiated by condensation of refrigerant, there is given an air-conditioning apparatus including a sensor for detecting an abnormality occurring in the air-conditioning apparatus, and being configured to, when the sensor detects the abnormality, display the occurrence of the abnormality on remote controllers or other devices. When a user recognizes the occurrence of the abnormality from the display of the remote controller or other devices, the user can contact a service provider that takes countermeasures against abnormality, and the service provider, which received the contact from the user, takes a countermeasure against the abnormality on the basis of the information from the user.

In related-art air-conditioning apparatus, there is given an air-conditioning apparatus, in which abnormalities that have occurred are sorted in order of significance, and then the abnormality with high significance is preferentially displayed. One of the abnormalities that may occur in the air-conditioning apparatus is a leakage of refrigerant. However, the leakage of refrigerant is dealt as the most significant abnormality in the air-conditioning apparatus using as the refrigerant a flammable refrigerant.

As a result, in the air-conditioning apparatus, there may cause a refrigerant leakage condition in which a leakage of refrigerant is detected and an abnormal condition in which an abnormality other than the leakage of refrigerant is detected. Note that, the causes of abnormalities other than the leakage of refrigerant include abnormal temperature of a component, abnormal pressure in a refrigerant circuit, and a communication abnormality.

For example, when the leakage of refrigerant occurs while an abnormality other than the leakage of refrigerant is being displayed, the leakage of refrigerant, which is more significant abnormality than the abnormality other than the leakage of refrigerant, is preferentially displayed, with the result that the display is overwritten to display only the leakage of refrigerant.

In such a case, the user contacts the service provider while recognizing only the leakage of refrigerant that has displayed preferentially, and the service provider consequently takes a countermeasure against the leakage of refrigerant on the basis of the contact from the user. A countermeasure to be taken against the leakage of refrigerant is, for example, repair of a refrigerant pipe forming a refrigeration cycle, and in this case, a procedure is followed in which, first, refrigerant is removed from the pipe, the pipe is then repaired, and refrigerant is injected again into the pipe. In such a manner, the service provider takes a countermeasure against the leakage of refrigerant after receiving contact related to the leakage of refrigerant from the user, and thus the leakage of refrigerant can be eliminated.

However, as described above, when an abnormality other than the leakage of refrigerant has been occurred before the leakage of refrigerant is eliminated, the display indicating the abnormality is overwritten by the display indicating the leakage of refrigerant, and thus the user and the service provider cannot recognize the abnormality other than the leakage of refrigerant. As a result, the service provider recognizes the abnormality other than the leakage of refrigerant after eliminating the leakage of refrigerant, and thus needs to take a countermeasure against the abnormality once again.

CITATION LIST

Patent Literature

Patent Literature 1: Japanese Unexamined Patent Application Publication No.
2008-170047

SUMMARY OF INVENTION

Technical Problem

In a related-art air-conditioning apparatus, when a refrigerant leakage condition and an abnormal condition have occurred together, only the refrigerant leakage condition is displayed. As a result, the user cannot inform the service provider about the abnormal condition, and thus there has been a problem in that the service provider cannot take a countermeasure against the abnormality when taking a countermeasure against the leakage of refrigerant.

The present invention has been made to solve the above-mentioned problem, and it is an object of the present invention to provide an air-conditioning apparatus that enables a user to recognize both a refrigerant leakage condition and an abnormal condition when the refrigerant leakage condition and the abnormal condition have occurred together.

Solution to Problem

In an embodiment of the present invention, when a refrigerant leakage condition, in which a leakage of refrigerant is detected, and an abnormal condition, in which an abnormality other than the leakage of refrigerant is detected, have occurred together, the refrigerant leakage condition and the abnormal condition are displayed together on a display part.

Advantageous Effects of Invention

In the air-conditioning apparatus of an embodiment of the present invention, the refrigerant leakage condition and the abnormal condition are displayed together on the display part, and therefore the user can recognize the refrigerant leakage condition and the abnormal condition at once.

DESCRIPTION OF EMBODIMENTS

Embodiment 1

Figure 1:
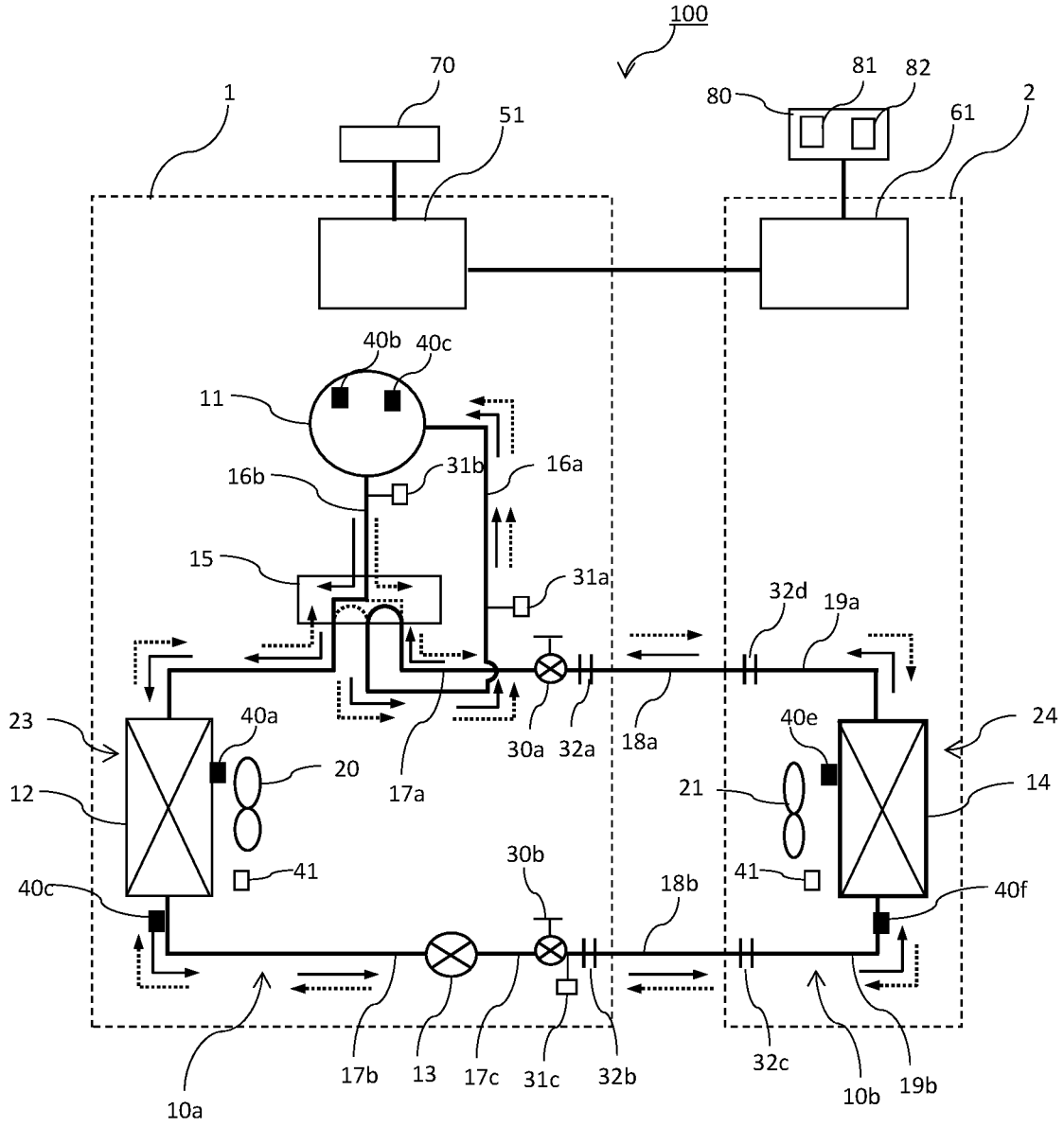
FIG. 1 is a configuration diagram for illustrating a schematic configuration of an air-conditioning apparatus according to Embodiment 1.

Embodiments of the present invention are described below. FIG. 1 is a configuration diagram for illustrating a schematic configuration of an air-conditioning apparatus according to Embodiment 1 of the present invention. In Embodiment 1, an air-conditioning apparatus 100, in which one indoor unit 2 is connected to one outdoor unit 1, is described.

The air-conditioning apparatus 100 includes an outdoor unit 1 as a heat source unit and an indoor unit 2 as a load unit, and a refrigerant circuit in which refrigerant circulates is provided inside the outdoor unit 1 and the indoor unit 2. The refrigerant circuit allows refrigerant to circulate in the refrigerant circuit, and forms a refrigeration cycle employing heat absorbed by the evaporation of the refrigerant and heat radiated by the condensation. The refrigerant circuit includes a compressor 11, an outdoor-unit-side heat exchanger 12, a pressure reduction device 13, and an indoor-unit-side heat exchanger 14, and is formed by connecting these devices by refrigerant pipes. The refrigerant circuit includes an outdoor-unit-side refrigerant circuit 10*a* provided inside the outdoor unit and an indoor-unit-side refrigerant circuit 10*b* provided inside the indoor unit, and the outdoor-unit-side refrigerant circuit 10*a* and the indoor-unit-side refrigerant circuit 10*b* are connected to each other by extension pipes 18*a* and 18*b*. That is, the outdoor unit 1 and the indoor unit 2 are connected to each other by the extension pipes 18*a* and 18*b*, which are refrigerant pipes.

Examples of the refrigerant that circulates in the refrigerant circuit include highly flammable refrigerants having flammability at a higher flammability level, such as R290 and R1270, and slightly flammable refrigerants having flammability, such as R32, HFO-1234yf, and HFO-1234ze. Hereinafter, refrigerant having flammability is referred to as a flammable refrigerant. As the flammable refrigerant, a single component refrigerant may be used or a mixed refrigerant in which two or more kinds of refrigerant are mixed may be used. In addition, a non-flammable refrigerant, such as R22 and R410A, can be also used as the refrigerant.

The configuration of the outdoor unit 1 is described. The outdoor unit 1 includes the outdoor-unit-side refrigerant circuit 10*a*, an outdoor-unit fan unit 20, a temperature sensor 40*a*, a current sensor 40*b*, and a pressure sensor 40*c* as sensors for detecting internal conditions of the air-conditioning apparatus 100, a refrigerant leakage sensor 41, an outdoor-unit controller 51, and an outdoor-unit display part 70.

The outdoor-unit-side refrigerant circuit 10*a* includes the compressor 11, the outdoor-unit-side heat exchanger 12, the pressure reduction device 13, and a refrigerant flow switching device 15, and includes, as refrigerant pipes, a suction pipe 16*a*, a discharge pipe 16*b*, and outdoor-unit pipes 17*a*, 17*b*, and 17*c*. In addition, the outdoor-unit-side refrigerant circuit 10*a* includes extension pipe connecting valves 30*a* and 30*b*, service ports 31*a*, 31*b*, and 31*c*, and joint portions 32*a* and 32*c*.

The compressor 11 sucks and compresses low-pressure refrigerant, and then discharges the refrigerant as high-pressure refrigerant. The outdoor-unit-side heat exchanger 12 is a heat exchanger that acts as a condenser in a cooling operation and acts as an evaporator in a heating operation. The pressure reduction device 13 reduces the pressure of the high-pressure refrigerant to obtain low-pressure refrigerant. As the pressure reduction device 13, for example, a solenoid expansion valve capable of adjusting an opening degree is used.

The refrigerant flow switching device 15 can switch the direction of flow of the refrigerant flowing in a refrigerant flow passage, between a cooling operation and a heating operation. As the refrigerant flow switching device 15, a four-way valve, for example, is used. In this case, the cooling operation is operation in which low-temperature low-pressure refrigerant is supplied to the indoor-unit-side heat exchanger 14, and the heating operation is operation in which high-temperature high-pressure refrigerant is supplied to the indoor-unit-side heat exchanger 14.

The outdoor-unit pipe 17*a* connects an extension pipe 18*a*, which connects the outdoor unit 1 and the indoor unit 2, and the refrigerant flow switching device 15. The suction pipe 16*a* is connected to the refrigerant flow switching device 15 and to a suction port of the compressor 11. In the suction pipe 16*a*, low-temperature low-pressure gas refrigerant or two-phase refrigerant is caused to flow both in cooling and in heating. The discharge pipe 16*b* is connected to a discharge port of the compressor 11 and to the outdoor-unit-side heat exchanger 12 via the refrigerant flow switching device 15. In the discharge pipe 16*b*, high-temperature high-pressure gas refrigerant that is compressed by the compressor 11 is caused to flow both in a cooling operation and in a heating operation. The outdoor-unit pipe 17*b* connects the outdoor-unit-side heat exchanger 12 and the pressure reduction device 13. The outdoor-unit pipe 17*c* connects the pressure reduction device 13 and the extension pipe 18*a*.

The outdoor-unit pipe 17*a* and the extension pipe 18*a* are connected to each other via the extension pipe connecting valve 30*a*. The extension pipe connecting valve 30*a* is formed of a two-way valve capable of switching between an open state and a closed state. In addition, the joint portion 32*a* is provided on the extension pipe 18*a* side of the extension pipe connecting valve 30*a* to connect the extension pipe connecting valve 30*a* and the extension pipe 18*a*.

The outdoor-unit pipe 17*c* and the extension pipe 18*b* are connected to each other via the extension pipe connecting valve 30*b*. The extension pipe connecting valves 30*a* and 30*b* are formed of three-way valves capable of switching between the open state and the closed state. In addition, the service port 31*c* and the joint portion 32*b* are provided on the extension pipe 18*b* side of the extension pipe connecting valve 30*b*. The service port 31*c* is used for vacuuming, which is performed before refrigerant is charged to the refrigerant circuit.

The suction pipe 16*a* includes a low-pressure-side service port 31*a*, and the discharge pipe 16*b* includes a high-pressure-side service port 31*b*. The service ports 31*a* and 31*b* are used for connection of pressure gauges to measure operation pressures during a test run in the installation or repair of the air-conditioning apparatus 100.

An outdoor-unit fan unit 20 is arranged to face the outdoor-unit-side heat exchanger 12 and sends outside air to the outdoor-unit-side heat exchanger 12. The outdoor-unit-side heat exchanger 12 exchanges heat between the refrigerant flowing inside the refrigerant circuit and the outside air sent by the outdoor-unit fan unit 20.

Inside the outdoor unit 1, the temperature sensor 40*a*, the current sensor 40*b*, and the pressure sensor 40*c* that are connected to the outdoor-unit controller 51 are provided. These sensors detect various internal conditions of the air-conditioning apparatus 100, and in the air-conditioning apparatus 100 of FIG. 1, the temperature sensor 40*a* that measures the temperature of the outside air sucked into the outdoor unit 1, the current sensor 40*b* that measures electric current flowing in the compressor 11, and the pressure sensor 40*c* that measures the pressure of the refrigerant inside the compressor 11 are installed. The sensors installed inside the outdoor unit 1 are not limited to these sensors, and may be any sensors that detect various internal conditions of the air-conditioning apparatus 100. The detection results of the sensors are used for properly controlling the air-conditioning apparatus 100 as well as for detecting abnormalities of the air-conditioning apparatus 100.

Further, the refrigerant leakage sensor 41 is provided inside the outdoor unit 1. As the refrigerant leakage sensor 41, for example, an energizing-type gas sensor, such as a semiconductor-type gas sensor, is used. The refrigerant leakage sensor 41 detects a leakage of refrigerant from a refrigerant pipe, and thus is installed in the vicinity of a connecting part or a joint portion of the refrigerant pipe. When refrigerant having a density higher than that of air under the atmospheric pressure is used, it is preferred that the refrigerant leakage sensor 41 be installed in a position lower than the outdoor-unit-side refrigerant circuit 10*a*.

Figure 2:
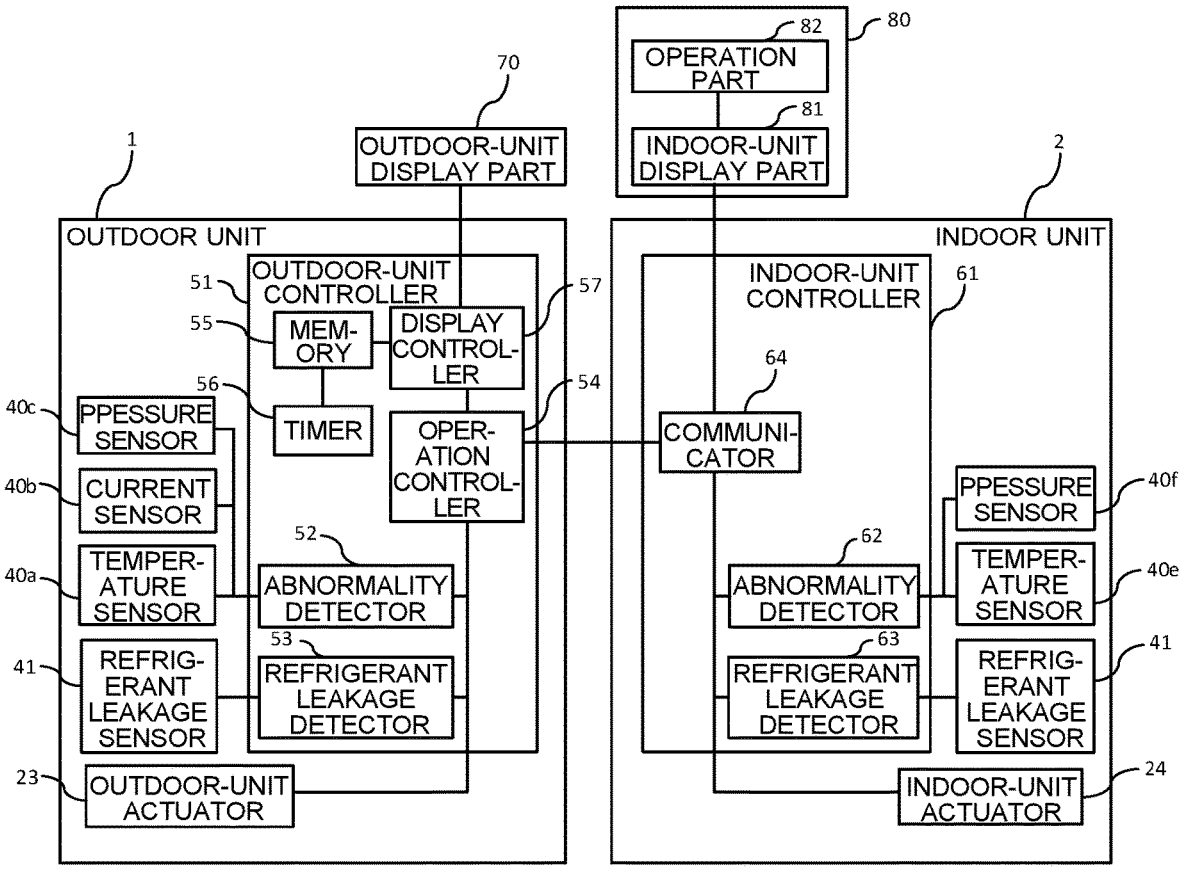
FIG. 2 is a block diagram for illustrating configurations of an outdoor-unit controller and an indoor-unit controller in an air-conditioning apparatus 100.

Next, the configuration of the outdoor-unit controller 51 is described with reference to FIG. 2. FIG. 2 is a block diagram for illustrating configurations of the outdoor-unit controller 51 and an indoor-unit controller 61 in the air-conditioning apparatus 100.

The outdoor-unit controller 51 is provided inside the outdoor unit 1, and is connected to the temperature sensor 40*a*, the current sensor 40*b*, the pressure sensor 40*c*, another refrigerant leakage sensor 41, and an outdoor-unit actuator 23 that includes components for causing the air-conditioning apparatus 100 to operate, such as the compressor 11, the pressure reduction device 13, the refrigerant flow switching device 15, and the outdoor-unit fan unit 20.

In addition, the outdoor-unit controller 51 includes an abnormality detector 52 to which the temperature sensor 40*a*, the current sensor 40*b*, and the pressure sensor 40*c* are connected, a refrigerant leakage detector 53 to which the refrigerant leakage sensor 41 is connected, an operation controller 54, a memory 55, a timer 56, and a display controller 57.

The abnormality detector 52 is connected to the operation controller 54. The refrigerant leakage detector 53 is connected to the operation controller 54. The operation controller 54 controls the overall operation of the air-conditioning apparatus 100, and is connected to the outdoor-unit actuator 23 and to the indoor-unit controller 61 provided in the indoor unit 2. In addition, the operation controller 54 is connected to the display controller 57 that controls display of the outdoor-unit display part 70.

The display controller 57 controls display of the outdoor-unit display part 70 and an indoor-unit display part 81, and is connected to the memory 55. The memory 55 records information regarding the air-conditioning apparatus 100, such as various internal conditions of the air-conditioning apparatus 100 detected by the sensors, setting temperatures of the air-conditioning apparatus 100, and operating conditions of the outdoor-unit actuator 23. Further, the memory 55 records an abnormality code table in which the types of the abnormalities, which are detected by the abnormality detector 52 and the refrigerant leakage detector 53, and abnormality codes are associated with each other. In addition, the timer 56 is connected to the memory 55.

The outdoor-unit display part 70 is connected to the outdoor-unit controller 51, and displays operation conditions of the air-conditioning apparatus 100 and other information on the basis of a signal from the display controller 57. When the air-conditioning apparatus 100 operates properly without falling into a refrigerant leakage condition or an abnormal condition, the outdoor-unit display part 70 displays content that is set by the user or displays an operation condition display screen that displays content of operation performed by the air-conditioning apparatus 100, indoor temperature, and other information.

Figure 3:
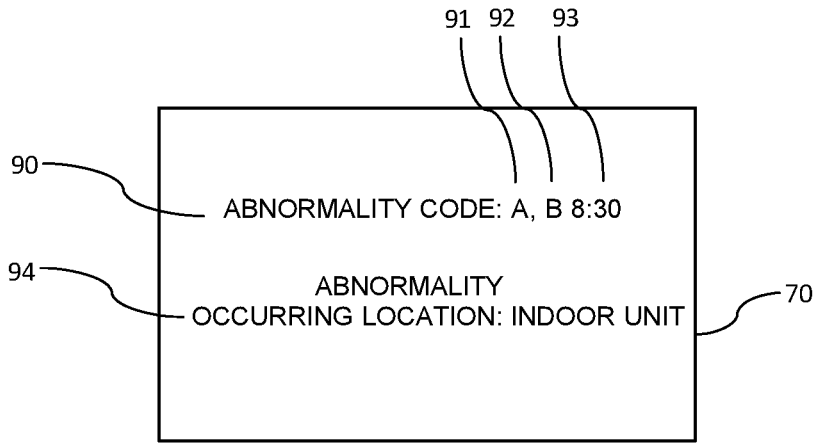
FIG. 3 is a diagram for illustrating an example of a display screen of Embodiment 1.

When an abnormal condition or a refrigerant leakage condition is detected by the abnormality detector 52 or the refrigerant leakage detector 53, the display controller 57 performs control for switching the display screen of the outdoor-unit display part 70 from the operation condition display screen to an abnormality display screen. An example of the abnormality display screen is illustrated in FIG. 3. The abnormality display screen of the outdoor-unit display part 70 includes a condition display area 90, a time display area 93, and an abnormality occurring location display area 94. In the condition display area 90, a first display area 91 and a second display area 92 are provided. On each of the first display area 91 and the second display area 92, a code indicating an abnormality or a code indicating a leakage of refrigerant is displayed. Consequently, a refrigerant leakage condition and an abnormal condition can be displayed together on the display part.

On the time display area 93, time elapsed from the occurrence of a leakage of refrigerant is displayed. On the abnormality occurring location display area 94, the location where a leakage of refrigerant or an abnormality is occurring is displayed. For example, the location may be displayed by indicating at which of the outdoor unit 1 and the indoor unit 2 the leakage of refrigerant or an abnormality is occurring, or may be displayed by indicating a specific device or component, for example, the compressor 11 of the outdoor unit 1.

Here, an example in which the whole display screen of the outdoor-unit display part 70 becomes an abnormality display screen is illustrated. However, the outdoor-unit display part 70 may display a screen in such a manner that, during a normal operation, an operation condition display screen is displayed, and, when an abnormality or a leakage of refrigerant is detected, an operation condition display screen and an abnormality display screen are displayed by dividing the display screen of the outdoor-unit display part 70.

Next, the configuration of the indoor unit 2 is described with reference to FIG. 1. The indoor unit 2 includes the indoor-unit-side refrigerant circuit 10*b*, an indoor-unit fan unit 21, a temperature sensor 40*e* and a pressure sensor 40*f* as sensors that detect internal conditions of the air-conditioning apparatus 100, the refrigerant leakage sensor 41, the indoor-unit controller 61, and a remote controller 80.

The indoor-unit-side refrigerant circuit 10*b* includes the indoor-unit-side heat exchanger 14, and indoor-unit pipes 19*a* and 19*b* as refrigerant pipes. In addition, the indoor-unit-side refrigerant circuit 10*b* includes joint portions 32*c* and 32*d*.

The indoor-unit-side heat exchanger 14 is a heat exchanger that acts as an evaporator in a cooling operation and acts as a condenser in a heating operation. The indoor-unit pipe 19*a* connects the indoor-unit-side heat exchanger 14 and the extension pipe 18*a*, and includes the joint portion 32*d* at an end on the extension pipe 18*a* side. The indoor-unit pipe 19*b* connects the indoor-unit-side heat exchanger 14 and the extension pipe 18*b*, and includes the joint portion 32*c* at an end on the extension pipe 18*b* side.

The indoor-unit fan unit 21 is arranged to face the indoor-unit-side heat exchanger 14, and sends outside air to the indoor-unit-side heat exchanger 14. The indoor-unit-side heat exchanger 14 exchanges heat between the refrigerant flowing inside the refrigerant circuit and the indoor air sent by the indoor-unit fan unit 21.

In addition, inside the indoor unit 2, the indoor-unit-side refrigerant circuit 10*b*, and the temperature sensor 40*e*, the pressure sensor 40*f*, and other sensors, which are connected to the indoor-unit controller 61, are provided. These sensors detect various internal conditions of the air-conditioning apparatus 100, and in the air-conditioning apparatus 100 of FIG. 1, the temperature sensor 40*e* that measures the temperature of the outside air sucked into the indoor unit 2, and the pressure sensor 40*f* that measures the internal pressure of the indoor-unit-side refrigerant circuit 10*b* are installed. The sensors installed inside the indoor unit 2 are not limited to these sensors, and may be any sensors that detect various internal conditions of the air-conditioning apparatus 100. The detection results of the sensors are used for properly controlling the air-conditioning apparatus 100 as well as for detecting abnormalities of the air-conditioning apparatus 100.

Next, the configuration of the indoor-unit controller 61 is described with reference to FIG. 2.

The indoor-unit controller 61 is provided inside the indoor unit 2, and is connected to the temperature sensor 40*e*, the pressure sensor 40*f*, the refrigerant leakage sensor 41, and an indoor-unit actuator 24 that causes the air-conditioning apparatus 100, including the indoor-unit fan unit 21, to operate.

In addition, the indoor-unit controller 61 includes an abnormality detector 62 to which the temperature sensor 40*e* and the pressure sensor 40*f* are connected, a refrigerant leakage detector 63 to which the refrigerant leakage sensor 41 is connected, and a communicator 64.

The abnormality detector 62 and the refrigerant leakage detector 63 are connected to the communicator 64. The communicator 64 is connected to the operation controller 54 of the outdoor unit 1, and is capable of mutually communicating between the outdoor-unit controller 51 and the indoor-unit controller 61. In addition, the communicator 64 is connected to the indoor-unit actuator 24 and to the indoor-unit display part 81.

Figure 4:
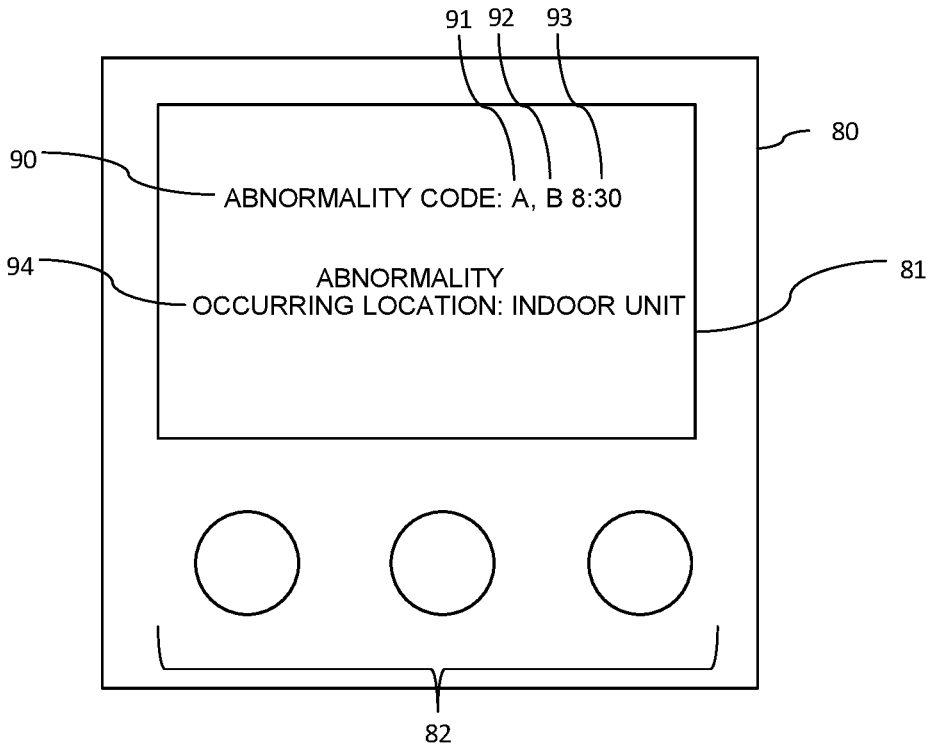
FIG. 4 is a front view of a remote controller of Embodiment 1.

Next, the configuration of the remote controller 80 is described with reference to FIG. 4. FIG. 4 is a front view of a remote controller of Embodiment 1.

The remote controller 80 includes the indoor-unit display part 81 and an operation part 82. The indoor-unit display part 81 is connected to the communicator 64 and to the operation part 82, and displays operation conditions of the air-conditioning apparatus 100 and other information. The operation part 82 receives operation made by the user, and transmits an operation signal based on the operation to the communicator 64. The indoor-unit display part 81 displays a screen similar to that of the outdoor-unit display part 70.

In the air-conditioning apparatus 100 configured as described above, on the basis of the operation signal from the operation part 82 and the detection signals from the sensors that detect internal conditions of the air-conditioning apparatus 100 and from the refrigerant leakage sensors 41, the operation controller 54 of the outdoor-unit controller 51 drives and controls the outdoor-unit actuator 23 and the indoor-unit actuator 24 to operate the air-conditioning apparatus 100 as a whole, thereby performing air conditioning.

Next, operations of the air-conditioning apparatus 100 are described.

First, operations of the refrigerant circuit during a cooling operation are described. In FIG. 1, solid line arrows indicate the direction of refrigerant flow during a cooling operation. In a cooling operation, the direction of refrigerant flow is switched by the refrigerant flow switching device 15 to the direction indicated by solid lines, with the result that low-temperature low-pressure refrigerant is caused to flow in the indoor-unit-side heat exchanger 14.

High-temperature high-pressure gas refrigerant that is discharged from the compressor 11 is first caused to flow into the outdoor-unit-side heat exchanger 12 via the refrigerant flow switching device 15. In a cooling operation, the outdoor-unit-side heat exchanger 12 acts as a condenser. That is, in the outdoor-unit-side heat exchanger 12, heat is exchanged between the outside air sent by the outdoor-unit fan unit 20 and the refrigerant flowing inside the outdoor-unit-side heat exchanger 12, and as a result, condensation heat of the refrigerant is radiated to the outside air. Consequently, the refrigerant that is caused to flow into the outdoor-unit-side heat exchanger 12 is condensed and becomes high-pressure liquid refrigerant. The high-pressure liquid refrigerant is caused to flow into the pressure reduction device 13, and is adiabatically expanded in the pressure reduction device 13 and becomes low-pressure two-phase refrigerant. The low-pressure two-phase refrigerant is caused to flow into the indoor-unit-side heat exchanger 14 of the indoor unit 2 via the extension pipe 18*b*. In a cooling operation, the indoor-unit-side heat exchanger 14 acts as an evaporator. That is, in the indoor-unit-side heat exchanger 14, heat is exchanged between the refrigerant flowing in the indoor-unit-side heat exchanger 14 and the indoor air sent by the indoor-unit fan unit 21, with the result that evaporation heat of the refrigerant is absorbed from the sent air. Consequently, the refrigerant that is caused to flow into the indoor-unit-side heat exchanger 14 is evaporated and becomes low-pressure gas refrigerant or two-phase refrigerant. In addition, the air sent by the indoor-unit fan unit 21 is cooled by the heat removing action of the refrigerant. The low-pressure gas refrigerant or two-phase refrigerant evaporated in the indoor-unit-side heat exchanger 14 is sucked into the compressor 11 via the extension pipe 18*a* and the refrigerant flow switching device 15. The refrigerant that is sucked into the compressor 11 is compressed and becomes high-temperature high-pressure gas refrigerant. In a cooling operation, the cycle described above is repeated.

Next, operations of the refrigerant circuit during a heating operation are described. In FIG. 1, dotted line arrows indicate the direction of refrigerant flow during a heating operation. In a heating operation, the direction of refrigerant flow is switched by the refrigerant flow switching device 15 to the direction indicated by dotted lines, and as a result, the flow of the refrigerant in the entire refrigerant circuit follows the direction indicated by the dotted lines. Thus, during a heating operation, the refrigerant is caused to flow in the direction opposite to the direction in a cooling operation such that high-temperature high-pressure refrigerant is caused to flow in the indoor-unit-side heat exchanger 14, and the indoor-unit-side heat exchanger 14 acts as a condenser. That is, in the indoor-unit-side heat exchanger 14, heat is exchanged between the indoor air sent by the indoor-unit fan unit 21 and the refrigerant flowing inside the indoor-unit-side heat exchanger 14, thereby rejecting condensation heat of the refrigerant to outside air. Consequently, the air sent by the indoor-unit fan unit 21 is heated by heat rejecting action of the refrigerant.

Next, operations of the outdoor-unit controller 51 and the indoor-unit controller 61 are described.

When the user starts the operation of the air-conditioning apparatus 100 by operating the operation part 82, an operation signal transmitted from the operation part 82 is transmitted to the operation controller 54 of the outdoor-unit controller 51 via the communicator 64. On the basis of the operation signal, the operation controller 54 transmits a control signal for starting operations of the outdoor unit 1 and the indoor unit 2 to the outdoor-unit actuator 23, the abnormality detector 52, the refrigerant leakage detector 53, and the communicator 64 of the indoor unit 2. On the basis of the control signal from the operation controller 54, the air-conditioning apparatus 100 starts a cooling operation or a heating operation.

When the operation of the air-conditioning apparatus 100 is started, the sensors 40*a* to 40*f* and the refrigerant leakage sensors 41 installed in the outdoor unit 1 and the indoor unit 2 detect the internal conditions of the air-conditioning apparatus 100. The sensors 40*a* to 40*f* each transmit the detected internal conditions of the air-conditioning apparatus 100 as detection signals to the abnormality detector 52 or 62. The abnormality detectors 52 and 62 detect an abnormality other than a leakage of refrigerant, and determine that, when a detection signal received from one of the sensors 40*a* to 40*f* exceeds a predetermined threshold value, there is an abnormality at the location where the one sensor is installed.

The refrigerant leakage sensors 41 detect the refrigerant concentrations in the air around the refrigerant leakage sensors 41 and transmit detection signals to each of the refrigerant leakage detectors 53 and 63. The refrigerant leakage detectors 53 and 63 each detect a leakage of refrigerant flowing in the refrigerant circuit, and determine that, when a detection signal received from the corresponding refrigerant leakage sensor 41 exceeds a predetermined threshold value, there is a leakage of refrigerant.

When an abnormality occurs inside the outdoor unit 1, the abnormality detector 52 detects the abnormality and transmits an abnormality signal indicating abnormality information to the operation controller 54. The abnormality information includes information on the detection of the abnormality and information on the location of the sensor that transmits the detection signal responsible for the detection of the abnormality. Through reception of an abnormality signal from the abnormality detector 52, the operation controller 54 can obtain information on the occurrence of the abnormality and the location where the abnormality occurs.

When a leakage of refrigerant occurs inside the outdoor unit 1, the refrigerant leakage detector 53 detects the leakage of refrigerant and transmits a refrigerant leakage signal, which is a signal indicating refrigerant leakage information, to the operation controller 54. The refrigerant leakage information includes information on the detection of the leakage of refrigerant and information on the location of the refrigerant leakage sensor 41 that transmits the detection signal responsible for the detection of the leakage of refrigerant. Through reception of a refrigerant leakage signal from the refrigerant leakage detector 53, the operation controller 54 can obtain information on the occurrence of the leakage of refrigerant and the location where the leakage of refrigerant occurs.

When an abnormality occurs inside the indoor unit 2, the abnormality detector 62 transmits an abnormality signal to the communicator 64, and the communicator 64, which receives the abnormality signal, transmits the abnormality signal to the operation controller 54 of the outdoor unit 1.

When a leakage of refrigerant occurs inside the outdoor unit 1, the refrigerant leakage detector 63 transmits a refrigerant leakage signal to the communicator 64, and the communicator 64, which receives the refrigerant leakage signal, transmits the refrigerant leakage signal to the operation controller 54 of the outdoor unit 1.

When receiving the abnormality signal or the refrigerant leakage signal, the operation controller 54 transmits a stop signal for stopping operation to the outdoor-unit actuator 23, and transmits a stop signal for stopping operation to the indoor-unit actuator 24 via the communicator 64 of the indoor unit 2. That is, when an abnormality or a leakage of refrigerant occurs inside the outdoor unit 1 or the indoor unit 2, the operation controller 54 of the outdoor-unit controller 51 controls and stops the indoor-unit actuator 24 and the indoor-unit actuator 24, thereby stopping the operation of air conditioning.

Even when the operation of air conditioning is stopped, the sensors 40*a* to 40*f*, the refrigerant leakage sensors 41, the outdoor-unit controller 51, the indoor-unit controller 61, the outdoor-unit display part 70, and the remote controller 80 are still activated, and hence detection of an abnormality, detection of a leakage of refrigerant, and operation of the remote controller 80 can be performed.

When receiving an abnormality signal or a refrigerant leakage signal, the operation controller 54 transmits the received abnormality signal or the received refrigerant leakage signal to the display controller 57.

Figure 5:
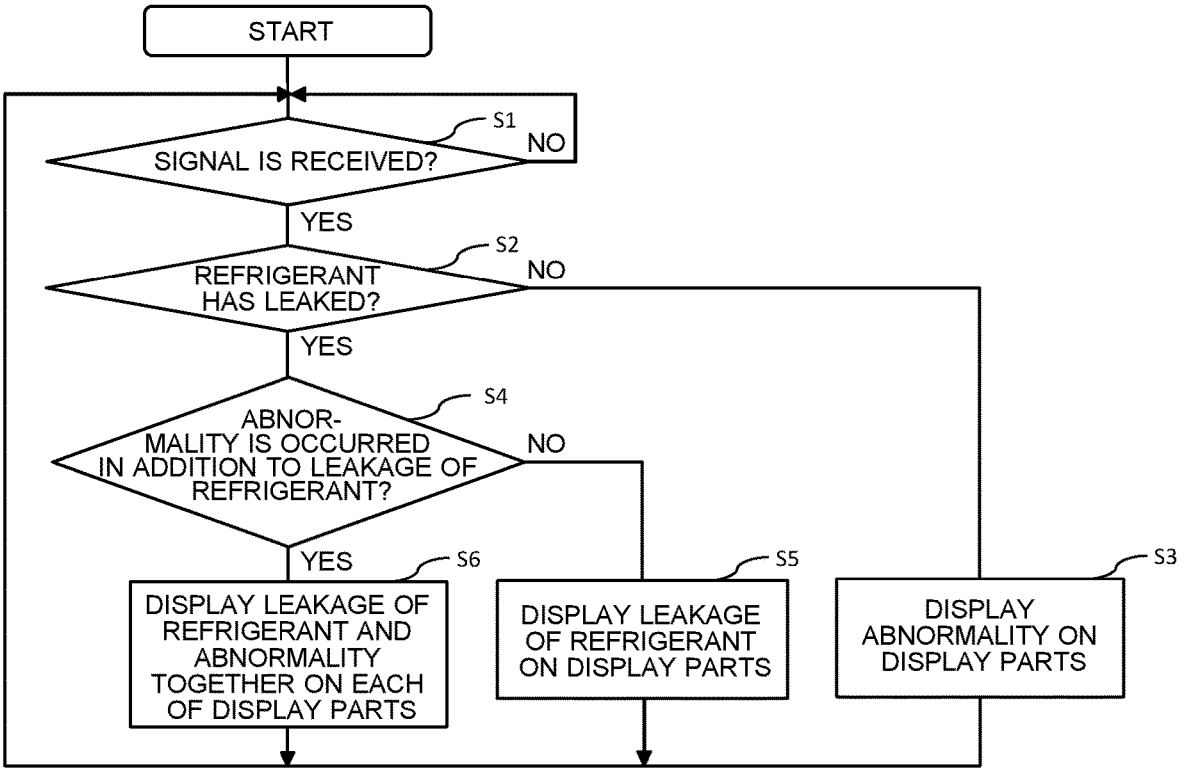
FIG. 5 is a flowchart for illustrating display control processing performed in a display controller.
Figure 6:
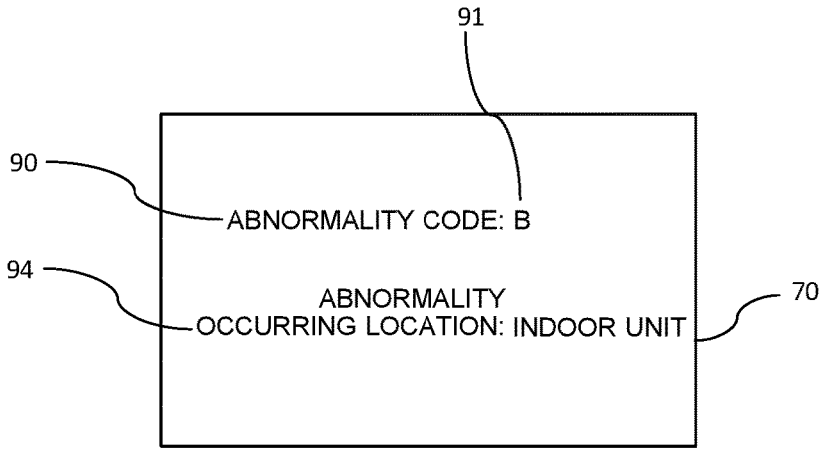
FIG. 6 is a diagram for illustrating an example of a display screen of Embodiment 1.
Figure 7:
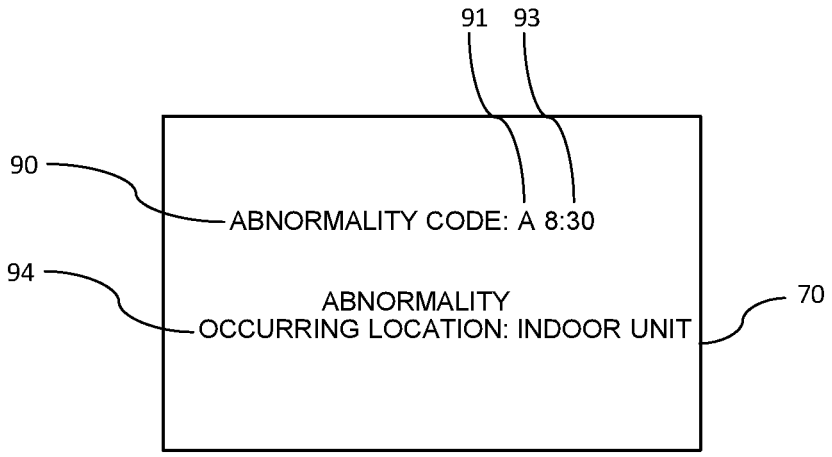
FIG. 7 is a diagram for illustrating an example of a display screen of Embodiment 1.
Figure 8:
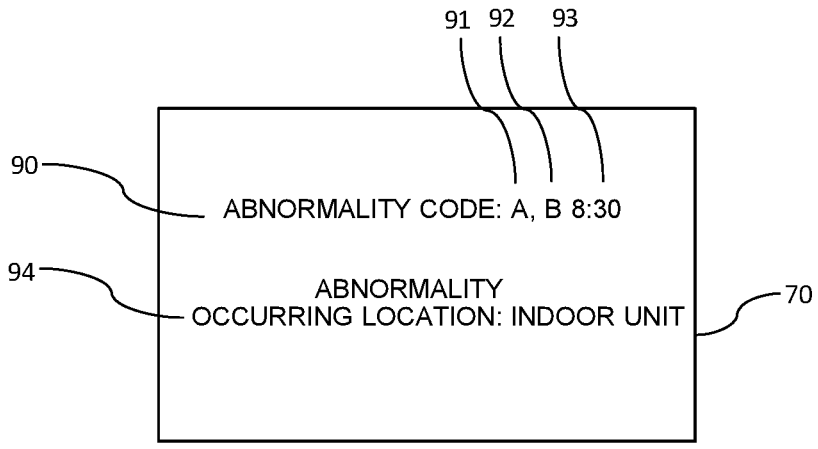
FIG. 8 is a diagram for illustrating an example of a display screen of Embodiment 1.

Next, operations in the display controller 57 of the outdoor-unit controller 51 and display methods of the outdoor-unit display part 70 and the indoor-unit display part 81 are described with reference to FIG. 5 to FIG. 8. FIG. 5 is a flowchart for illustrating display control processing performed in the display controller 57, and FIG. 6 to FIG. 8 are diagrams for illustrating examples of a display screen of the outdoor-unit display part 70.

When, in Step S1, the display controller 57 receives an abnormality signal or a refrigerant leakage signal from the operation controller 54, the display controller 57, in Step S2, records the abnormality information or the refrigerant leakage information in the memory 55 and determines whether or not a leakage of refrigerant has occurred on the basis of the received signal. The determination of whether or not a leakage of refrigerant has occurred indicates whether or not the refrigerant leakage detector 53 has detected a leakage of refrigerant. A condition in which the refrigerant leakage detector 53 has detected a leakage of refrigerant is a condition in which, after the refrigerant leakage detector 53 detected a leakage of refrigerant, the service provider has not fixed the leakage or the service provider has not reset the displays of the outdoor-unit display part 70 and the indoor-unit display part 81.

When, in Step S2, the display controller 57 determines that a leakage of refrigerant has not occurred, the process proceeds to Step S3. In Step S3, the display controller 57 refers to the abnormality code table, which is recorded in advance, and determines an abnormality code corresponding to the abnormality. When the abnormality code is determined, the display controller 57 transmits a signal for switching the screen of the outdoor-unit display part 70 and the indoor-unit display part 81 from the operation condition display screen to the abnormality display screen. In addition, the display controller 57 transmits a signal for displaying the abnormality code on the condition display area 90 and a signal for displaying the location of the occurrence of the abnormality on the abnormality occurring location display area to the outdoor-unit display part 70 and the indoor-unit display part 81. When these signals are transmitted to the indoor-unit display part 81, the signals are transmitted via the communicator 64 on the indoor unit 2 side. In the outdoor-unit display part 70 and the indoor-unit display part 81 that receive the signals for displaying the abnormality on the condition display areas 90, the abnormality code is displayed on the condition display area 90, and the location where the abnormality is occurring is displayed on the abnormality occurring location display area 94. An example of a display screen in this case is illustrated in FIG. 6. For example, when an abnormality of abnormality code B occurs in the indoor unit, the abnormality code "B" is displayed on the first display area 91, and "INDOOR UNIT" is displayed on the abnormality occurring location display area 94.

When, in Step S2, the display controller 57 determines that a leakage of refrigerant has occurred, the process proceeds to Step S4, and, in Step S4, the display controller 57 determines whether or not an abnormality has occurred in addition to the leakage of refrigerant. The determination of whether or not an abnormality has occurred in addition to the leakage of refrigerant indicates whether or not the abnormality detector 52 has detected an abnormality while the refrigerant leakage detector 53 has detected the leakage of refrigerant. A condition in which the abnormality detector 52 has detected a leakage of refrigerant is a condition in which, after the abnormality detector 52 detected an abnormality, the service provider has not fixed the abnormality or the service provider has not reset the displays of the outdoor-unit display part 70 and the indoor-unit display part 81.

When, in Step S4, the display controller 57 determines that an abnormality has not occurred while the leakage of refrigerant has occurred, the display controller 57 refers to the abnormality code table, which is recorded in advance, and determines an abnormality code corresponding to the leakage of refrigerant. In addition, in Step S2, an elapsed time since the refrigerant leakage information was recorded in the memory 55 is calculated by using a timer, and the elapsed time is recorded in the memory 55.

When the abnormality code is determined, the display controller 57 transmits a signal for switching the screens of the outdoor-unit display part 70 and the indoor-unit display part 81 from the operation condition display screen to the abnormality display screen. In addition, the display controller 57 transmits a signal for displaying the abnormality code on the condition display areas 90, a signal for displaying the location of the occurrence of the leakage of refrigerant on the abnormality occurring location display areas, and a signal for displaying the elapsed time counted by the timer 56, to the outdoor-unit display part 70 and the indoor-unit display part 81. When these signals are transmitted to the indoor-unit display part 81, the signals are transmitted via the communicator 64 on the indoor unit 2 side.

In the outdoor-unit display part 70 and the indoor-unit display part 81 that each receive the signal from the display controller 57, in Step S5, the abnormality code is displayed on the condition display area 90, the location where the leakage of refrigerant is occurring is displayed on the abnormality occurring location display area 94, and the elapsed time since the leakage of refrigerant occurred is displayed on the time display area 93. An example of a display screen in this case is illustrated in FIG. 7. For example, when eight hours and thirty minutes have passed since a leakage of refrigerant occurred in the indoor unit, an abnormality code "A" is displayed on the first display area 91, "INDOOR UNIT" is displayed on the abnormality occurring location display area 94, and the elapsed time "8:30" is displayed on the time display area 93.

When, in Step S4, the display controller 57 determines that an abnormality has occurred while the leakage of refrigerant has occurred, the display controller 57 refers to the abnormality code table, which is recorded in advance, and determines an abnormality code corresponding to the leakage of refrigerant and an abnormality code corresponding to the abnormality. In addition, in Step S4, an elapsed time since the refrigerant leakage information was recorded in the memory 55 is calculated by using a timer, and the elapsed time is recorded in the memory 55.

When the abnormality code is determined, the display controller 57 transmits a signal for switching the screens of the outdoor-unit display part 70 and the indoor-unit display part 81 from the operation condition display screens to the abnormality display screens. In addition, the display controller 57 transmits a signal for displaying the abnormality code on the condition display areas 90, a signal for displaying the location of the occurrence of the leakage of refrigerant on the abnormality occurring location display areas, and a signal for displaying the elapsed time counted by the timer 56 to the outdoor-unit display part 70 and the indoor-unit display part 81. When these signals are transmitted to the indoor-unit display part 81, the signals are transmitted to the indoor unit 2 side via the communicator 64.

In the outdoor-unit display part 70 and the indoor-unit display part 81 that receive the signal from the display controller 57, in Step S6, the abnormality code is displayed on the condition display area 90, the location where the leakage of refrigerant is occurring is displayed on the abnormality occurring location display area 94, and the elapsed time since the leakage of refrigerant occurred is displayed on the time display area 93. An example of a display screen in this case is illustrated in FIG. 8. For example, when a leakage of refrigerant and an abnormality of abnormality code B occur in the indoor unit and eight hours and thirty minutes have passed since the leakage of refrigerant occurred, an abnormality code "A" is displayed on the first display area 91, and an abnormality code "B" is displayed on the second display area 92. In addition, "INDOOR UNIT" is displayed on the abnormality occurring location display area 94, and the elapsed time "8:30" is displayed on the time display area 93.

When an abnormality is displayed on the outdoor-unit display part 70 and the indoor-unit display part 81 in Step S3, S5, or S6, the processing returns to Step S1, and operations of Steps S1 to S6 are repeated.

The user can recognize an abnormality by checking the abnormality display screen of the outdoor-unit display part 70 or the indoor-unit display part 81, and can request repair from the service provider. The service provider can recognize the conditions of the air-conditioning apparatus 100 by asking the user about the displayed abnormality codes, and can prepare necessary tools for repairing in advance before going for the repair.

Resetting of the display of the abnormality codes is allowed after the service provider takes appropriate countermeasures and switches on again the power of the air-conditioning apparatus 100. When resetting of the display of the abnormality codes by operations of the remote controller 80 or other operations is not allowed until the service provider takes appropriate countermeasures, the abnormality codes can be prevented from being lost due to unintended operations.

In the air-conditioning apparatus 100 of Embodiment 1 described above, when the refrigerant leakage detector 53 detects a leakage of refrigerant and the abnormality detector 52 detects an abnormality, the display controller 57 causes the outdoor-unit display part 70 and the indoor-unit display part 81 to display the refrigerant leakage condition and the abnormal condition, thereby allowing the user to see the leakage of refrigerant and the abnormal condition at once. The user can inform the service provider of the leakage of refrigerant and the abnormal condition, and thus, the service provider can recognize the leakage of refrigerant and the abnormal condition before repairing, and can handle the abnormal condition while taking a countermeasure against the leakage of refrigerant.

Further, the service provider can recognize the leakage of refrigerant and the abnormal condition before repairing, and hence the service provider can prepare necessary tools for repairing in advance before going to the repair site. As a result, the service provider can work efficiently.

In addition, the refrigerant leakage condition and the abnormality are displayed on the same display screen, and hence the user can recognize the refrigerant leakage and the abnormal condition easily.

In FIG. 6, there is illustrated a case in which a single abnormality occurs; however, when a plurality of abnormalities occur, the abnormality codes may be displayed on the first display area 91 and the second display area 92. In addition, in Embodiment 1, a case in which the condition display area 90 has two display areas is described; however, two or more display areas may be provided. Through provision of two or more display areas, two or more conditions can be displayed when two or more abnormal conditions have occurred or when two or more abnormal conditions and a refrigerant leakage condition have occurred. As a result, the operation conditions of the air-conditioning apparatus 100 can be recognized in detail.

Further, in FIG. 8, there is illustrated a case in which the abnormality code "A" corresponding to a leakage of refrigerant is displayed on the first display area 91 and the abnormality code "B" corresponding to an abnormal condition is displayed on the second display area 92; however, any arrangement may be used as long as a leakage of refrigerant can be always recognized from the display when the leakage of refrigerant has occurred. The abnormality code "B" corresponding to an abnormal condition may be displayed on the first display area 91 and the abnormality code "A" corresponding to a leakage of refrigerant may be displayed on the second display area 92. In addition, although there is illustrated in FIG. 8 a case in which the first display area 91 and the second display area 92 are arranged horizontally, the first display area 91 and the second display area 92 may be arranged vertically as long as the configuration allows a leakage of refrigerant and an abnormal condition to be recognized from the same screen.

The time to be displayed on the time display area 93 is sequentially updated over time.

The time displayed on the time display area 93 is the time elapsed from the occurrence of a leakage of refrigerant; however, the time when a leakage of refrigerant occurred may be displayed instead. In addition, the time elapsed from the occurrence of an abnormal condition or the time when an abnormal condition occurred may be displayed. With such display, the service provider can check the histories of the abnormal conditions and the leakages of refrigerant occurred in the air-conditioning apparatus 100, and can perform repair work efficiently upon understanding the failure condition of the air-conditioning apparatus 100 in detail.

Further, it is sufficient to display the location where an abnormality is occurring on the abnormality occurring location display area 94, and a specific location where an abnormality is occurring, for example, "JOINT PORTION OF INDOOR UNIT" or "EXTENSION PIPE CONNECTING VALVE OF OUTDOOR UNIT", may be displayed. With such display, the service provider can understand the location to be repaired and can perform repair efficiently.

In addition, in Embodiment 1, the abnormality code corresponding to a leakage of refrigerant or an abnormal condition is displayed on the condition display area 90; however, any display method, for example, displaying with characters, may be used as long as a leakage of refrigerant or an abnormal condition can be recognized.

Embodiment 2

Figure 9:
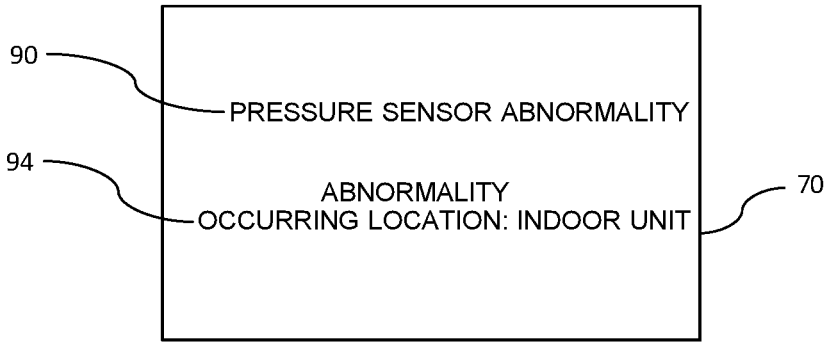
FIG. 9 is a diagram for illustrating an example of a display screen of Embodiment 2.
Figure 10:
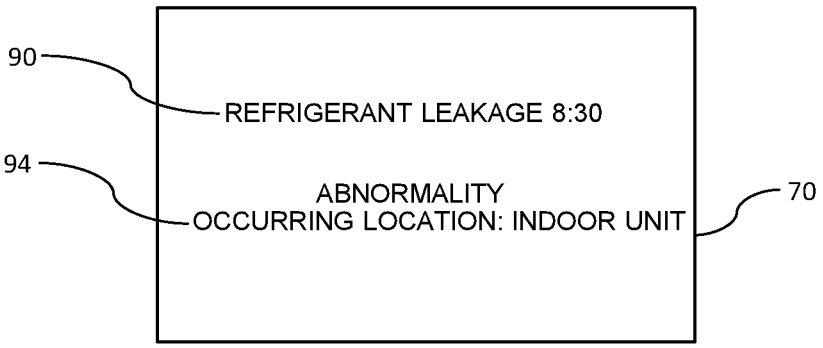
FIG. 10 is a diagram for illustrating an example of a display screen of Embodiment 2.
Figure 11:
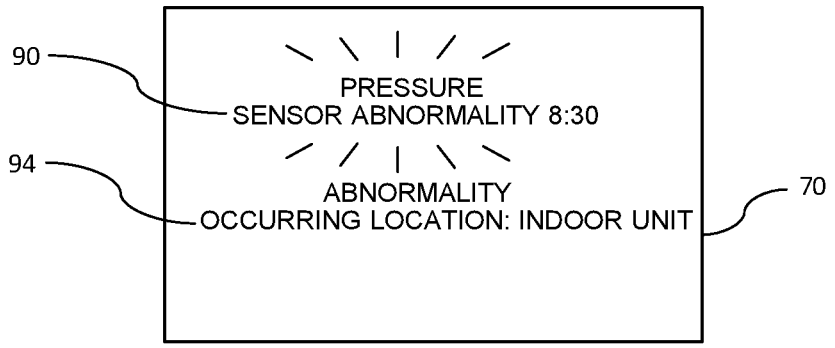
FIG. 11 is a diagram for illustrating an example of a display screen of Embodiment 2.

FIG. 9 to FIG. 11 are diagrams for illustrating examples of a display screen of the outdoor-unit display part 70 of the air-conditioning apparatus 100 according to Embodiment 2. In Embodiment 2, features that are different from those of Embodiment 1 are mainly described. The parts that are common to those of Embodiment 1 are denoted by the same reference signs, and the descriptions of the parts are omitted.

In Embodiment 1, the first display area 91 and the second display area 92, which are configured to individually display a refrigerant leakage condition and an abnormal condition, are provided in the condition display area 90 of a single abnormality display screen; however, in Embodiment 2, an example in which, when an abnormal condition and a leakage of refrigerant have occurred together, the abnormal condition and the refrigerant leakage condition are displayed using a single area is described. Specifically, while the abnormal condition is displayed with characters, the refrigerant leakage condition is displayed using a display method different from a display method for a case in which there is only an abnormal condition, that is, a case in which the abnormal condition has occurred but the refrigerant leakage detector 63 does not detect a leakage of refrigerant, and as a result, the refrigerant leakage condition can be recognized. The different display method means that, when, for example, a display method in which characters indicating an abnormal condition are displayed continuously when only an abnormal condition has occurred is used, the display method is changed to a display method in which characters indicating the abnormal condition are flashed, rather than being displayed continuously, when a refrigerant leakage condition and an abnormal condition are detected together.

An example of a display method in which an abnormal condition is displayed with characters and a leakage of refrigerant is displayed by flashing the characters that indicate the abnormal condition is described with reference to FIG. 5 and FIG. 9 to FIG. 12.

First, a display method in Step S3 is described. When, in Step S2, the display controller 57 determines that a leakage of refrigerant has not occurred, the display controller 57 transmits a signal for displaying an abnormal condition with characters on the condition display area 90 and a signal for displaying the location of the occurrence of the abnormality on the abnormality occurring location display area to the outdoor-unit display part 70 and the indoor-unit display part 81. In the outdoor-unit display part 70 and the indoor-unit display part 81 that receive the signal for displaying the abnormal condition on the condition display area 90, the abnormal condition is displayed on the condition display area 90 and the location where the abnormality is occurring is displayed on the abnormality occurring location display area 94 in Step S3. An example of a display screen in this case is illustrated in FIG. 9. For example, when a pressure sensor abnormality occurs in the indoor unit, the characters of "PRESSURE SENSOR ABNORMALITY" are continuously displayed on the first display area 91, and "INDOOR UNIT" is continuously displayed on the abnormality occurring location display area 94.

Next, a display method in Step S5 is described. When, in Step S4, the display controller 57 determines that an abnormality has not occurred while the leakage of refrigerant has occurred, the display controller 57 transmits a signal for displaying a refrigerant leakage condition with characters on the condition display area 90 and a signal for displaying the location of the occurrence of the leakage of refrigerant on the abnormality occurring location display area to the outdoor-unit display part 70 and the indoor-unit display part 81. In the outdoor-unit display part 70 and the indoor-unit display part 81 that receive the signal for displaying the refrigerant leakage condition on the condition display area 90, the refrigerant leakage condition is displayed on the condition display area 90 and the location where the abnormality is occurring is displayed on the abnormality occurring location display area 94 in Step S5. An example of a display screen in this case is illustrated in FIG. 10. For example, when a leakage of refrigerant occurs in the indoor unit, the characters of "REFRIGERANT LEAKAGE" are displayed on the first display area 91, and "INDOOR UNIT" is displayed on the abnormality occurring location display area 94.

Figure 12:
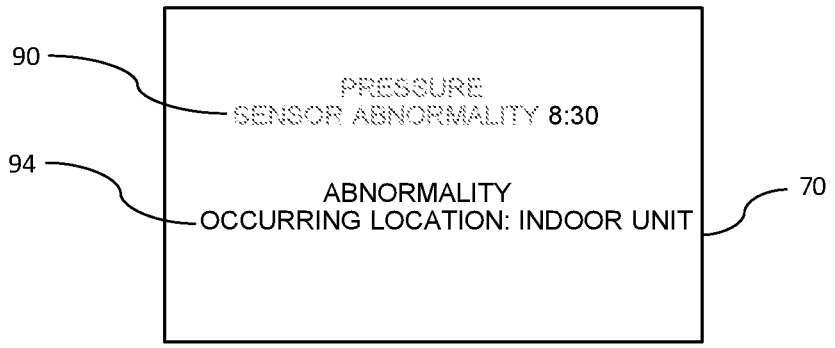
FIG. 12 is a diagram for illustrating an example of a display screen of Embodiment 2.

Next, a display method in Step S6 is described. When, in Step S4, the display controller 57 determines that an abnormality has occurred while the leakage of refrigerant has not occurred, the display controller 57 transmits a signal for displaying an abnormal condition with flashing characters on the condition display area 90 and a signal for displaying the locations of the occurrences of the abnormal condition and the leakage of refrigerant on the abnormality occurring location display area to the outdoor-unit display part 70 and the indoor-unit display part 81. In the outdoor-unit display part 70 and the indoor-unit display part 81 that receive the signal for displaying the abnormal condition with flashing characters on the condition display area 90, in Step S6, the abnormal condition is displayed with the flashing characters on the condition display area 90, and the locations where the abnormal condition and the leakage of refrigerant are occurring are displayed on the abnormality occurring location display area 94. Examples of display screens in this case are illustrated in FIG. 11 and FIG. 12. FIG. 11 is a diagram for illustrating a display screen on which an abnormal condition is displayed, and FIG. 12 is a diagram for illustrating a display screen on which an abnormal condition is not displayed. Flashing of the abnormal condition display is obtained by alternately showing the display screens of FIG. 11 and FIG. 12. For example, when a pressure sensor abnormality and a leakage of refrigerant occur in the indoor unit, the characters of "PRESSURE SENSOR ABNORMALITY" are flashed and displayed on the first display area 91, and "INDOOR UNIT" is displayed on the abnormality occurring location display area 94.

In the air-conditioning apparatus 100 of Embodiment 2 described above, when a refrigerant leakage condition and an abnormal condition have occurred together, there is adopted the display method in which the abnormal condition is displayed on a single condition display area 90 with characters while the characters are being flashed. Thus, the user can inform the service provider of the display method of the characters indicating the abnormal condition, and so that the service provider can recognize the leakage of refrigerant and the abnormal condition.

In addition, because the characters are flashing, the characters catch user's attention more than when the characters do not flash, and as a result, the user can quickly recognize the refrigerant leakage condition.

In addition, because the abnormal condition is displayed with characters, the user can recognize the content of the abnormal condition that is occurring.

Further, because a leakage of refrigerant and an abnormal condition can be displayed on the same area, the condition display areas of the outdoor-unit display part 70 and the indoor-unit display part 81 having limited areas can be used efficiently.

In Embodiment 2, an abnormal condition is displayed with characters and a refrigerant leakage condition can be recognized by using a display method in which the characters are flashed, and which is different from a display method in which the characters are displayed continuously when there is only the abnormal condition. However, a leakage of refrigerant may be displayed with characters, and the characters may be flashed when there is an abnormal condition in addition to the leakage of refrigerant. In this case, however, it is necessary to set a different display method for each abnormal condition to discern which abnormal condition is occurring.

In addition, other than the display method in which the characters are flashed when a refrigerant leakage condition has occurred, the characters may be displayed by changing the color or by flashing the background. Through change of the color of the characters, the characters catch user's attention more, and as a result, the user can quickly recognize the refrigerant leakage condition. Through flash of the background of the characters, a larger area flashes, thereby being recognized easily. Further, when a leakage of refrigerant is displayed by characters and an abnormal condition is displayed by changing the color of the characters, a plurality of abnormal conditions can be displayed by setting different colors for different abnormal conditions.

Further, a single abnormal condition is displayed on the condition display area 90; however, a plurality of abnormal conditions may be displayed with characters on the condition display area 90, and a leakage of refrigerant may be displayed by flashing the characters or by changing the color of the characters.

In addition, an abnormal condition or a refrigerant leakage condition may be displayed with an abnormality code, instead of characters.

Embodiment 3

In Embodiment 1, a refrigerant leakage condition and an abnormal condition are displayed regardless of the types of the abnormal conditions; however, in Embodiment 3, when an abnormal condition that is related to a leakage of refrigerant and an abnormal condition that is unrelated to the leakage of refrigerant have occurred among the abnormal conditions, the abnormal condition that is related to the leakage of refrigerant is preferentially displayed. In Embodiment 3, features that are different from those of Embodiment 1 are mainly described. The parts that are common to those of Embodiment 1 are denoted by the same reference signs, and the descriptions of the parts are omitted. For each abnormal condition, an abnormal condition table recorded in a memory 55 of Embodiment 3 contains information on whether or not the abnormal condition is related to a leakage of refrigerant or information on the degree of relation to refrigerant.

In Embodiment 3, operations for a case in which the display controller 57 determines in Step S4 of FIG. 5 that a leakage of refrigerant and an abnormal condition have occurred are described. When, in Step S4, the display controller 57 determines that a leakage of refrigerant and an abnormal condition have occurred together, the display controller 57 refers to the abnormal condition table, which is recorded in advance in the memory 55, and determines whether or not the abnormal condition detected by the abnormality detector 52 is an abnormal condition that is related to a leakage of refrigerant. Abnormal conditions related to a leakage of refrigerant are abnormal conditions in a refrigerant circuit, including, for example, a temperature abnormality and a pressure abnormality in the refrigerant circuit, and an abnormality of electric current flowing in the components of the refrigerant circuit such as the compressor 11 and the pressure reduction device 13.

Abnormal conditions other than the abnormal conditions related to a leakage of refrigerant are abnormal conditions for the parts that are not directly connected to the refrigerant circuit, including, for example, abnormalities of communication between the outdoor-unit controller 51 and the indoor-unit controller 61, and malfunctions of the outdoor-unit fan unit 20 and the indoor-unit fan unit 21.

When the detected abnormal condition is determined as an abnormal condition related to a leakage of refrigerant, the display controller 57 transmits a signal for preferentially displaying the abnormal condition related to the leakage of refrigerant on the condition display areas 90 and a signal for displaying the location where the leakage of refrigerant is occurring on the abnormality occurring location display areas.

In the outdoor-unit display part 70 and the indoor-unit display part 81 that receive the signal from the display controller 57, the abnormal condition related to the leakage of refrigerant is displayed on the condition display areas 90 and the location where the leakage of refrigerant is occurring is displayed on the abnormality occurring location display areas 94 in Step S6.

In addition, when the detected abnormal condition is determined as not being an abnormal condition related to a leakage of refrigerant, the detected abnormal condition does not need to be preferentially displayed, and thus, the display controller 57, when an abnormal condition related to a leakage of refrigerant has been displayed before the occurred abnormal condition is detected, transmits, to the condition display areas 90, a signal for preferentially displaying the previous abnormal condition, or, when an abnormal condition related to a leakage of refrigerant has not been displayed, a signal for displaying the abnormal condition recently detected. Consequently, when a leakage of refrigerant and an abnormal condition other than an abnormal condition related to the leakage of refrigerant have occurred, the leakage of refrigerant and the abnormal condition other than an abnormal condition related to the leakage of refrigerant are displayed.

In the air-conditioning apparatus 100 of Embodiment 3 described above, when the refrigerant leakage detector 53 detects a leakage of refrigerant and the abnormality detector 52 detects an abnormal condition related to the leakage of refrigerant, the refrigerant leakage condition and the abnormal condition related to the leakage of refrigerant can be preferentially displayed together on the outdoor-unit display part 70 and the indoor-unit display part 81. To handle the abnormal condition related to a leakage of refrigerant, there are cases where a countermeasure is taken after all refrigerant is removed from a refrigerant circuit and then an operation of injecting refrigerant again is required. However, by displaying the conditions as described above, the abnormal condition related to a leakage of refrigerant is preferentially displayed, and as a result, the abnormal condition related to the leakage of refrigerant can be recognized preferentially to an abnormal condition unrelated to the leakage of refrigerant so that a countermeasure against the abnormal condition can be taken when a countermeasure against the leakage of refrigerant is taken, and thus the need for removing refrigerant and injecting refrigerant again for every countermeasure is eliminated. Consequently, work time can be shortened and the amount of usage of the refrigerant can be reduced.

Even when an abnormal condition other than an abnormal condition related to a leakage of refrigerant is displayed after a countermeasure against a leakage of refrigerant is taken, a countermeasure against such an abnormal condition can be taken under a condition in which the refrigerant is injected in a refrigerant circuit, and consequently, the abnormal condition other than an abnormal condition related to a leakage of refrigerant may be displayed after the countermeasure against the leakage of refrigerant and the countermeasures against the abnormal condition related to the leakage of refrigerant are taken.

In addition, when setting is made in advance for an abnormal condition related to a leakage of refrigerant to display an abnormal condition that requires replacement of a part in a refrigerant circuit, the service provider can prepare necessary parts in advance and understand in advance the procedure for taking countermeasures before starting work.

Further, because an abnormal condition related to a leakage of refrigerant is displayed, when more abnormal conditions occur than the outdoor-unit display part 70 and the indoor-unit display part 81 can display, the abnormal condition related to a leakage of refrigerant can be displayed preferentially.

In the above descriptions, it is determined whether or not an abnormal condition is related to a leakage of refrigerant. However, a degree of relation to a leakage of refrigerant is recorded for each abnormal condition, and an abnormal condition may be displayed preferentially on the basis of the degree.

Embodiment 4

In Embodiments 1 to 3, the air-conditioning apparatus 100 has one indoor unit 2 connected to one outdoor unit 1; however, in Embodiment 4, an air-conditioning apparatus 200 has a plurality of indoor units 2 connected to one outdoor unit 1. In Embodiment 4, features that are different from those of Embodiment 1 are mainly described. The parts that are common to those of Embodiment 1 are denoted by the same reference signs, and the descriptions of the parts are omitted.

Figure 13:
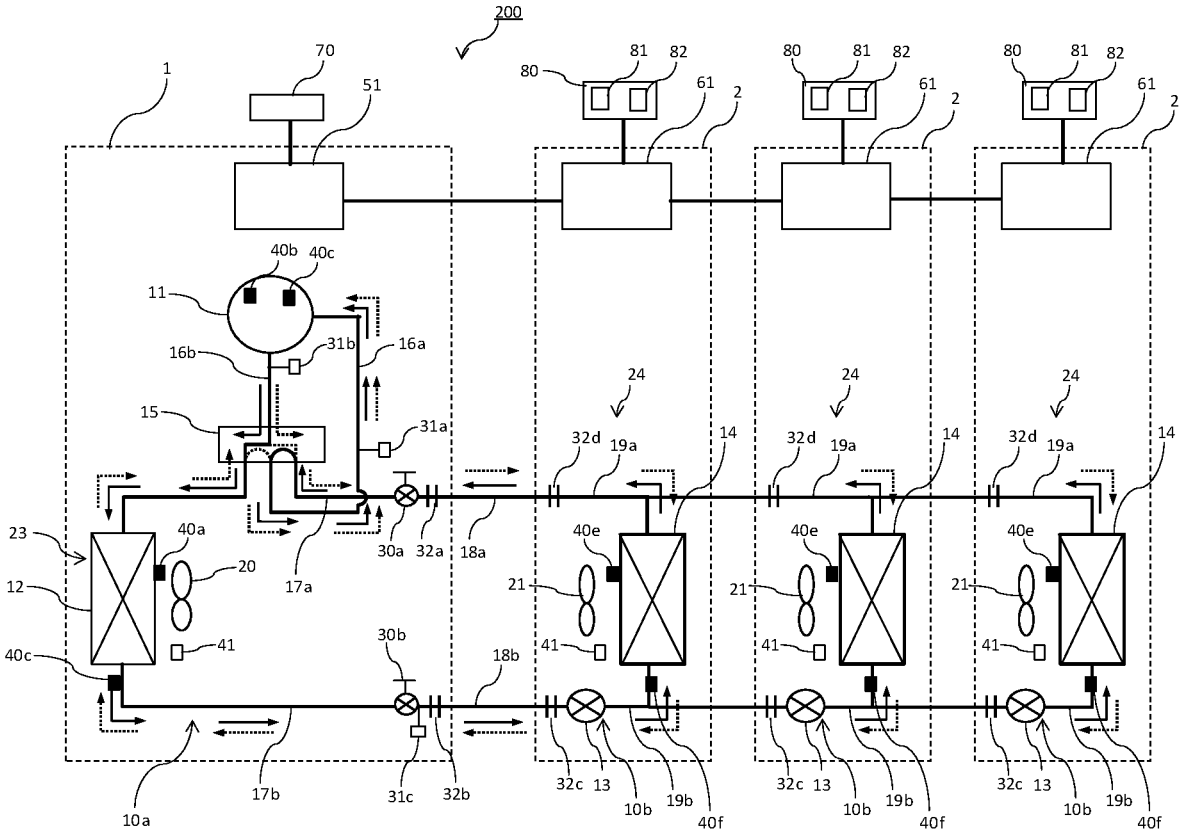
FIG. 13 is a configuration diagram for illustrating a schematic configuration of an air-conditioning apparatus according to Embodiment 4.

FIG. 13 is a configuration diagram for illustrating a schematic configuration of an air-conditioning apparatus according to Embodiment 4.

The air-conditioning apparatus 200 includes an outdoor unit 1 and a plurality of indoor units 2, and the outdoor unit 1 and the individual indoor units 2 are connected via refrigerant pipes for circulating refrigerant. The air-conditioning apparatus 100 according to Embodiment 1 has the configuration in which the pressure reduction device 13 is provided on the outdoor-unit-side refrigerant circuit 10*a*, however, the air-conditioning apparatus 200 has a configuration in which a pressure reduction device 13 is provided in each indoor unit 2. That is, the outdoor-unit-side refrigerant circuit 10*a* includes a compressor 11, an outdoor-unit-side heat exchanger 12, and a refrigerant flow switching device 15, and further includes, as refrigerant pipes, a suction pipe 16*a*, a discharge pipe 16*b*, and outdoor-unit pipes 17*a* and 17*b*. In addition, indoor-unit-side refrigerant circuits 10*b* each include an indoor-unit-side heat exchanger 14 and the pressure reduction device 13, and further includes, as refrigerant pipes, indoor-unit pipes 19*a* and 19*b*.

Each indoor unit 2 includes an indoor-unit controller 61, and a remote controller 80 is connected to each indoor-unit controller 61. The indoor-unit controllers 61 of the indoor units 2 are electrically connected to each other via communicators 64. At least one indoor-unit controller 61 is connected to an outdoor-unit controller 51, and as a result, all the indoor units 2 are electrically connected to the outdoor unit 1.

Next, operations of the air-conditioning apparatus 200 are described. When receiving an abnormality signal or a refrigerant leakage signal, an operation controller 54 transmits a stop signal for stopping operation to an outdoor-unit actuator 23, and transmits a stop signal for stopping operation to an indoor-unit actuator 24 via the communicator 64 of each indoor unit 2. That is, when an abnormality or a leakage of refrigerant occurs inside the outdoor unit 1 or the indoor unit 2, the operation controller 54 of the outdoor-unit controller 51 controls and stops the indoor-unit actuator 24 and the indoor-unit actuators 24 of all the indoor units 2, thereby stopping the operation of air conditioning.

When a refrigerant leakage detector 53 detects a leakage of refrigerant and an abnormality detector 52 detects an abnormality, a display controller 57 transmits a signal for displaying the refrigerant leakage condition and the abnormal condition on an outdoor-unit display part 70 and all indoor-unit display parts 81. The outdoor-unit display part 70 and all the indoor-unit display parts 81 that receive the signal from the display controller 57 display the refrigerant leakage condition and the abnormal condition together on condition display areas 90.

In the air-conditioning apparatus 200 of Embodiment 4 described above, when the refrigerant leakage detector 53 detects a leakage of refrigerant and the abnormality detector 52 detects an abnormality, the display controller 57 transmits a signal for displaying the refrigerant leakage condition and the abnormal condition on the outdoor-unit display part 70 and all the indoor-unit display parts 81, and as a result, the leakage of refrigerant and the abnormal condition in the air-conditioning apparatus 200 can be checked from the indoor-unit display part 81 connected to each indoor unit 2.

In addition, the remote controllers 80 of the indoor units 2 can be installed in a plurality of places, and therefore when a leakage of refrigerant or an abnormal condition has occurred, the leakage of refrigerant or the abnormal condition can be checked from the plurality of places.

In Embodiments 1 to 4, the operation controller 54 and the display controller 57 are provided in the outdoor-unit controller 51; however, there may be adopted a configuration in which the operation controller 54 and the display controller 57 are provided in the indoor-unit controller 61, or a configuration in which the operation controller 54 and the display controller 57 are provided in both the outdoor-unit controller 51 and the indoor-unit controller 61, as long as operations of the outdoor unit 1 and the indoor unit 2 are controlled in the configuration. In particular, when a plurality of indoor units 2 are connected to one outdoor unit 1 as in Embodiment 4, by providing the operation controller 54 for controlling operation of each indoor unit 2 in each indoor-unit controller 61, the circuits of the outdoor-unit controller 51 and the indoor-unit controller 61 can be easily designed. In addition, the operation controller 54 and the display controller 57 may be of any configuration as long as the operation controller 54 and the display controller 57 can communicate with the outdoor unit 1 and the indoor unit 2, and the operation controller 54 and the display controller 57 may be provided in a controller other than the outdoor-unit controller 51 or the indoor-unit controller 61. For example, there may be adopted a configuration in which the operation controller 54 and the display controller 57 are provided on the remote controller 80 side, or a configuration in which the operation controller 54 and the display controller 57 are provided in an external device to and from which communication is performed.

Further, although the display controller 57 displays the same content on the outdoor-unit display part 70 and the indoor-unit display part 81, the display controller 57 may display different contents for the outdoor unit 1 and the indoor units 2. For example, when an abnormal condition has occurred in the outdoor unit 1 and an indoor unit 2, the abnormal condition of the outdoor unit 1 may be displayed on the outdoor-unit display part 70, and the abnormal condition of the indoor unit 2 may be displayed on the indoor-unit display part 81. With such a configuration, an abnormal condition of the outdoor unit 1, which is connected to the outdoor-unit display part 70, or an abnormal condition of each indoor unit 2, which is connected to the corresponding indoor-unit display part 81, can be recognized preferentially from the outdoor-unit display part 70 or the indoor-unit display part 81.

In addition, although the display controller 57 performs display on the outdoor-unit display part 70 connected to the outdoor unit 1 and the indoor-unit display part 81 connected to the indoor unit 2, the display controller 57 may perform display on an external device as a display part, for example, a mobile terminal, as long as the display allows the user to recognize a leakage of refrigerant and an abnormal condition in the air-conditioning apparatus 100 or the air-conditioning apparatus 200. With such a configuration, the user can recognize a leakage of refrigerant and an abnormal condition from a place remote from the outdoor-unit display part 70 or the indoor-unit display part 81.

INDUSTRIAL APPLICABILITY

The air-conditioning apparatus according to the embodiments of the present invention can be widely utilized as an air-conditioning apparatus for household or commercial use.

REFERENCE SIGNS LIST

1 outdoor unit 2 indoor unit 10*a* outdoor-unit-side refrigerant circuit

10*b* indoor-unit-side refrigerant flow path 11 compressor 12 outdoor-unit-side heat exchanger 13 pressure reduction device 14 indoor-unit-side heat exchanger 15 refrigerant flow switching device 16*a* suction pipe 16*b* discharge pipe 17*a*, 17*b*, 17*c* outdoor-unit pipe 18*a*, 18*b* extension pipe

19*a*, 19*b* indoor-unit pipe 20 outdoor-unit fan unit 21 indoor-unit fan unit 23 outdoor-unit actuator 24 indoor-unit actuator 30*a*, 30*b* extension pipe connecting valve 31*a*, 31*b*, 31*c* service port 32*a*, 32*b*, 32*c* joint portion

40*a* temperature sensor 40*b* current sensor 40*c*, 40*d* pressure sensor 41 refrigerant leakage sensor 51 outdoor-unit controller 52 abnormality detector 53 refrigerant leakage detector 54 operation controller 55 memory 56 timer 57 display controller 61 indoor-unit controller 62 abnormality detector 63 refrigerant leakage detector 64 communicator 70 outdoor-unit display part 80 remote controller 81 indoor-unit display part 82 operation part 90 condition display area 91 first display area 92 second display area 93 time display area 94 abnormality occurring location display area

The invention claimed is:

1. An air-conditioning apparatus, comprising:

a refrigerant circuit, through which refrigerant is caused to flow;

a refrigerant leakage detector configured to detect a leakage of the refrigerant flowing through the refrigerant circuit;

an abnormality detector configured to detect an abnormality other than the leakage of the refrigerant; and a display controller configured to cause a display part to display both a first identifier identifying the leakage of the refrigerant detected by the refrigerant leakage detector and a second identifier identifying the abnormality detected by the abnormality detector when both the refrigerant leakage detector detects the leakage of the refrigerant and the abnormality detector detects the abnormality, wherein the display controller is configured to cause the display part to display the second identifier with a first display method when the abnormality detector detects the abnormality but the refrigerant leakage detector does not detect the leakage of the refrigerant, and to cause the display part to display the second identifier with a second display method when the abnormality detector detects the abnormality and the refrigerant leakage detector detects the leakage of the refrigerant, the first display method displays the second identifier with continuous characters, and the second display method displays the second identifier with one of: flashing characters, characters with flashing a background of a display screen in the display part, and characters in a different color than in the first display method.

2. The air-conditioning apparatus of claim 1, wherein the display controller is configured to cause the display part to display both the first identifier and the second identifier on a single display screen of the display part when both the refrigerant leakage detector detects the leakage of the refrigerant and the abnormality detector detects the abnormality.

3. The air-conditioning apparatus of claim 1, wherein the display controller is configured to determine whether or not the abnormality detected by the abnormality detector is related to the leakage of the refrigerant, and to cause the display part to display an appropriate identifier corresponding to a first abnormality that is determined to be related to the leakage of the refrigerant in preference to a second abnormality that is determined to be unrelated to the leakage of the refrigerant.

4. The air-conditioning apparatus of claim 1, wherein the second identifier includes a first abnormality code that identifies a first abnormality relating to the leakage of the refrigerant and a second abnormality code different from the first abnormality code that identifies the abnormality detected by the abnormality detector.

5. An air-conditioning apparatus, comprising:

a refrigerant circuit, through which refrigerant is caused to flow;

a first abnormality detector configured to detect a first abnormality;

a second abnormality detector configured to detect a second abnormality different from the first abnormality; and a display controller configured to cause a display part to display both a first identifier identifying the first abnormality and a second identifier identifying the second abnormality when both the first abnormality detector detects the first abnormality and the second abnormality detector detects the second abnormality, wherein the first abnormality is a leakage of the refrigerant flowing through the refrigerant circuit, and the first abnormality detector is a refrigerant leakage detector, the display controller is configured to cause the display part to display the second identifier with a first display method when the second abnormality detector detects the second abnormality but the first abnormality detector does not detect the first abnormality, and to cause the display part to display the second identifier with a second display method when the second abnormality detector detects the second abnormality and the first abnormality detector detects the first abnormality, the first display method displays the second identifier with continuous characters, and the second display method displays the second identifier with one of: flashing characters, characters with flashing a background of a display screen in the display part, and characters in a different color than in the first display method.

6. The air-conditioning apparatus of claim 5, wherein the display controller is configured to cause the display part to display both the first identifier and the second identifier on a single display screen of the display part when both the first abnormality detector detects the first abnormality and the second abnormality detector detects the second abnormality.

7. The air-conditioning apparatus of claim 5, wherein the display controller is configured to determine that the second abnormality detected by the second abnormality detector is related to the leakage of the refrigerant, and to cause the display part to display as the second identifier a third identifier corresponding to the leakage of the refrigerant in preference to a fourth identifier corresponding to an abnormality unrelated to the leakage of the refrigerant.

8. The air-conditioning apparatus of claim 5, wherein the first identifier is a first abnormality code that identifies the first abnormality and the second identifier is a second abnormality code different from the first abnormality code that identifies the second abnormality.

* * * * *